US009404504B2

(12) United States Patent
Sakai

(10) Patent No.: US 9,404,504 B2
(45) Date of Patent: Aug. 2, 2016

(54) BLOWER

(71) Applicant: SHINANO KENSHI KABUSHIKI KAISHA, Ueda-shi, Nagano (JP)

(72) Inventor: Takeki Sakai, Ueda (JP)

(73) Assignee: SHINANO KENSHI KABUSHIKI KAISHA, Ueda-shi (JP)

( * ) Notice: Subject to any disclaimer, the term of this patent is extended or adjusted under 35 U.S.C. 154(b) by 432 days.

(21) Appl. No.: 13/963,048

(22) Filed: Aug. 9, 2013

(65) Prior Publication Data

US 2014/0112805 A1 Apr. 24, 2014

(30) Foreign Application Priority Data

Oct. 22, 2012 (JP) ..... 2012-232632

(51) Int. Cl.

| | |
|---|---|
| ***F04D 29/44*** | (2006.01) |
| ***F04D 29/54*** | (2006.01) |
| ***F04D 29/056*** | (2006.01) |
| ***F04D 17/16*** | (2006.01) |
| ***F04D 25/06*** | (2006.01) |

(Continued)

(52) U.S. Cl.

CPC ..... *F04D 29/056* (2013.01); *F04D 17/16* (2013.01); *F04D 25/0606* (2013.01); *F04D 25/082* (2013.01); *F04D 29/051* (2013.01); *F04D 29/4213* (2013.01); *F04D 29/584* (2013.01)

(58) Field of Classification Search

CPC . F04D 29/056; F04D 25/082; F04D 29/4213; F04D 29/584; F04D 25/0606; F04D 29/051; F04D 17/16

USPC ..... 415/1, 204; 310/166, 90; 417/423.12

See application file for complete search history.

(56) References Cited

U.S. PATENT DOCUMENTS 3,960,468 A * 6/1976 Boorse ..... F04D 13/0613 415/104
5,124,997 A * 6/1992 Funakubo ..... F04D 29/059 372/34

(Continued)

FOREIGN PATENT DOCUMENTS

CN 1594890 A 3/2005
CN 2773358 Y 4/2006

(Continued)

OTHER PUBLICATIONS

Office Action dated Aug. 24, 2015, issued in counterpart Chinese Application No. 201310422133.3, with English translation (14 pages).

(Continued)

*Primary Examiner* — Hoang Nguyen

(74) *Attorney, Agent, or Firm* — Westerman, Hattori, Daniels & Adrian, LLP

(57) ABSTRACT

The blower comprises: a stator being provided in a case; a radial bearing being provided in the case; a rotor shaft being provided in the case and supported by the stator and the radial bearing; a rotor being integrated with the rotor shaft; and an impeller being integrated with the rotor shaft, the impeller sucking a fluid into the case from an axial direction and sending the same in the circumferential direction of the impeller. The impeller is attached to the rotor shaft to make a blade forming surface of the impeller face the rotor in the axial direction. A shaft end of the rotor shaft, which is located on the opposite side of the impeller, is supported by a thrust receiving member.

3 Claims, 3 Drawing Sheets

(51) Int. Cl.

| | |
|---|---|
| ***F04D 29/051*** | (2006.01) |
| ***F04D 25/08*** | (2006.01) |
| ***F04D 29/42*** | (2006.01) |
| ***F04D 29/58*** | (2006.01) |

(56) References Cited

U.S. PATENT DOCUMENTS

| | | | | |
|---|---|---|---|---|
| 7,535,150 | B1 * | 5/2009 | Wilson | F04D 29/056 310/166 |
| 2009/0087299 | A1 * | 4/2009 | Agrawal | F04D 29/584 415/1 |

FOREIGN PATENT DOCUMENTS

| | | | |
|---|---|---|---|
| CN | 202250971 | U | 5/2012 |
| JP | 11-218092 | A | 8/1999 |
| JP | 4159992 | B2 | 10/2008 |
| JP | 2008-267238 | A | 11/2008 |

OTHER PUBLICATIONS

Japanese Office Action dated Apr. 8, 2014, issued in corresponding Japanese Patent Application No. 2012-232632 (2 pages).

* cited by examiner

BLOWER

CROSS-REFERENCE TO RELATED APPLICATION

This application is based upon and claims the benefit of priority of the prior Japanese Patent Application No. P2012-232632, filed on Oct. 22, 2012, and the entire contents of which are incorporated herein by reference.

FIELD

The present invention relates to a blower used as, for example, a medical blower for curing a sleep apnea syndrome.

BACKGROUND

Conventional blowers used for a continuous positive airway pressure therapy are shown in FIGS. 4 and 5 as examples. In each of the blowers, a scroll case 53 is constituted by a first part 51 and a second part 52, and a motor M and a rotatable impeller 55 are provided in the case 53.

A bearing housing 56, which is formed into a cylindrical shape, is attached to the first part 51. A motor circuit board 57 and a stator 58 are attached to the bearing housing 56. A rolling bearing, e.g., a ball bearing 59 shown in FIG. 4, or a slide bearing, e.g., an oil retaining bearing 60 shown in FIG. 5, which receives a radial load (a load in a radial direction of a rotor shaft 61) and a thrust load (a load in an axial direction of the rotor shaft 61), is attached in the bearing housing 56 so as to rotatably hold the rotor shaft 61. The impeller 55 is fixed to the rotor shaft 61 by, for example, molding, adhesive bonding or press fitting. A rotor 62 is constituted by a cup-shaped rotor yoke and a ring magnet (not shown), which is fixed on an inner circumferential face of the rotor yoke and which faces pole teeth of a stator.

The impeller 55 is provided on the second part 52 side. An inlet 52*a*, from which a fluid (air) is sucked, is formed at a center of the second part 52. The impeller 55 is attached to the rotor shaft 61, and blades 55*a* are faced toward the inlet 52*a*. A compression chamber 63 is formed around the impeller 55. An outlet (not shown), which is communicated with the compression chamber 63, is extended from the second part 52 in a tangential direction.

By stating the motor M, the impeller 55 is rotated together with the rotor 62 and the fluid is sucked from the inlet 52*a*. The sucked fluid is introduced radially outward, by the blades 55*a*, and compressed in the compression chamber 63. Then, the compressed fluid is discharged from the outlet. The above described blower is used as, for example, a turbine of a breathing assistance unit (see Japanese Patent No. 4159992).

In the above describe blower, the fluid is sucked from the inlet 52*a* formed at a center of the impeller 55, so that negative pressure is produced in the vicinity of the inlet 52*a*. On the other hand, positive pressure is produced in the vicinity of the outlet and on the rear sides of the impeller 55. Therefore, a lifting force F, which lifts the impeller 44 from the motor M side toward the blade 55*a* side, is applied to the impeller 55. The lifting force F acting on the impeller 55 is increased by increasing the fluid pressure produced by the impeller 55, and the force F sometimes exceeds an attractive force generated between the rotor magnet and the pole teeth of the stator.

Thus, interference between the impeller 55 and the second part 52 must be prevented. In case of using the ball bearing shown in FIG. 4 as the rolling bearing, the rotor shaft 61 is supported in the thrust direction, so the lifting force F acting on the impeller 55 causes no problems.

However, the rolling bearing, e.g., ball bearing, capable of receiving the loads in both of the radial direction and the thrust direction is expensive.

Further, in case of using the slide bearing shown in FIG. 5, e.g., oil retaining bearing, the slide bearing can receive the load in the radial direction, but cannot receive the load in the thrust direction. Thus, as shown in FIG. 5, the rotor shaft 61 is retained by retaining means, e.g., a snap ring 64.

However, in case that the rotor is rotated at a high speed or the lifting force F is too great, the retaining means will be abraded in a short time.

In case that a movement of the impeller 55 in the axial direction is limited by a thrust receiving member which prevents the interference between the impeller 55 and the second part 52, the thrust receiving member can be provided on the motor M side. But, the inlet 52*a* is formed in the impeller 55 side, so the thrust receiving member cannot be provided on the impeller 55 side.

SUMMARY

Accordingly, it is an object to provide a blower capable of solving the above described problems of the conventional blowers. Namely, the blower of the present invention is capable of restraining a lift of an impeller, for a long time, by using a bearing which does not support a rotor shaft in a thrust direction, and the blower has a simple structure and can be easily assembled.

To achieve the object, the present invention has following structures.

Namely, the blower of the present invention comprises:

a case;

a stator being provided in the case;

a radial bearing being provided in the case;

a rotor shaft being provided in the case and supported by the stator and the radial bearing;

a rotor being integrated with the rotor shaft; and an impeller being integrated with the rotor shaft, the rotating impeller sucking a fluid into the case from an axial direction and sending the same in the circumferential direction of the impeller, the impeller is attached to the rotor shaft to make a blade forming surface of the impeller face the rotor in the axial direction, and a shaft end of the rotor shaft, which is located on the opposite side of the impeller, is supported by a thrust receiving member.

With this structure, by starting a motor and rotating the impeller, a lifting force axially acts on the impeller to lift the impeller toward the motor, but the shaft end of the rotor shaft is supported by the thrust receiving member. Therefore, the movement of the impeller in the axial direction is prohibited, so that interference between the impeller and the case can be prevented and reliability of the blower can be improved.

Even in case that the blower is operated at a high speed and the lifting force, which lifts the impeller, is great, the lift of the impeller in the axial direction can be prevented by, for example, forming the shaft end face, which contacts the thrust receiving member on the motor side, into a gradually-rounded face.

Further, the bearing housing, the radial bearing, the motor and the impeller are attached to the case from one side, so the structure can be simplified and the blower can be assembled easily.

Preferably, the fluid is sucked into the case from the motor side and sent in the circumferential direction of the rotating impeller. With this structure, the fluid is sucked from the motor side, where heat is generated, so that heat generation of the motor can be restrained.

Preferably, the radial bearing does not support the rotor shaft in the thrust direction. With this structure, an expensive ball bearing, which can receives loads in the radial direction and the thrust direction, is unnecessary. Therefore, a production cost of the blower can be reduced.

Preferably, the radial bearing is a slide bearing. With this structure, generation of noise can be restrained, a shock resistance can be improved, and a span of life can be extended.

In the blower of the present invention, the lift of the impeller can be restrained, for a long time, by using, for example, the slide bearing which does not support the rotor shaft in the thrust direction. Further, the simple blower, which can be easily assembled, can be provided.

BRIEF DESCRIPTION OF THE DRAWINGS

Embodiments of the present invention will now be described by way of examples and with reference to the accompanying drawings.

DESCRIPTION OF THE PREFERRED EMBODIMENTS

Preferred embodiments of the present invention will now be described in detail with reference to the accompanying drawings.

A blower of the present embodiment is an air blower used for curing a sleep apnea syndrome.

A slide bearing is used as an example of a radial bearing for supporting a rotor shaft.

Firstly, a schematic structure of the air blower will be explained with reference to FIGS. 1-3.

Figure 1:
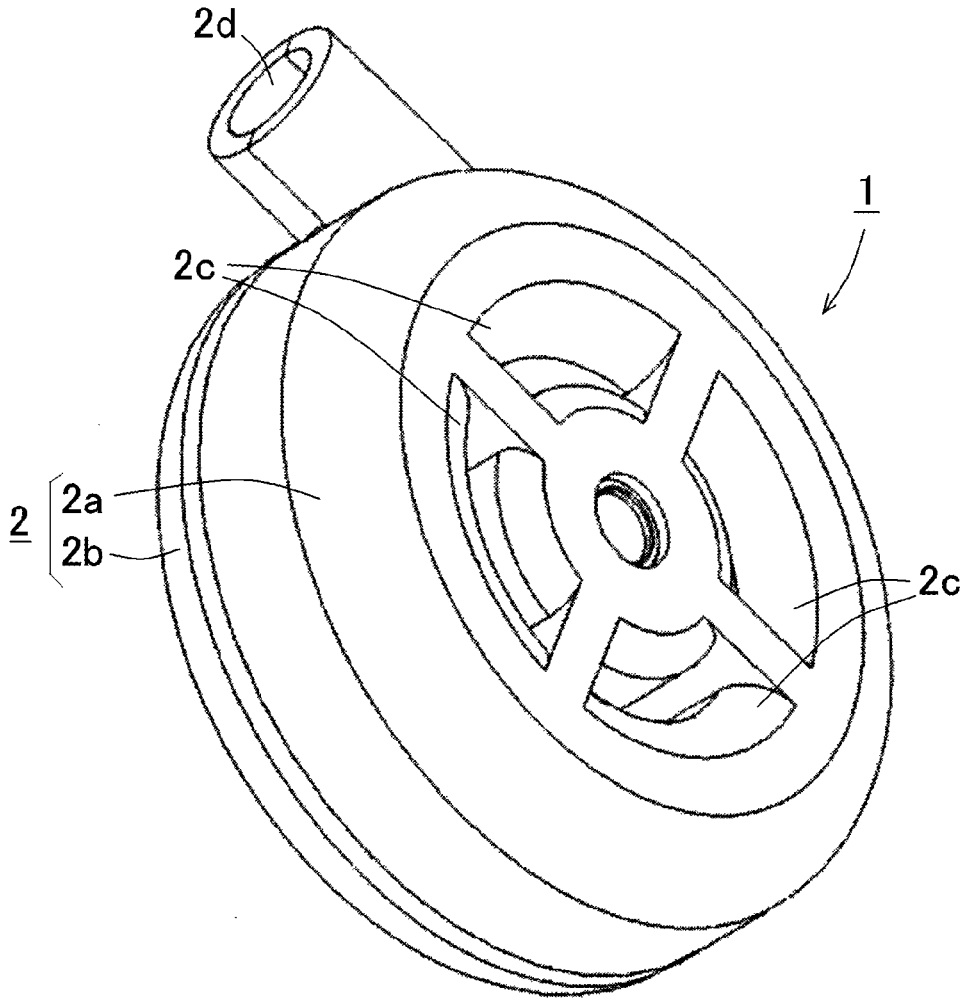
FIG. 1 is a perspective view of a blower of an embodiment of the present invention.

In FIG. 1, a case 2 of the air blower 1 is constituted by a first part 2*a* and a second part 2*b*. An inlet 2*c*, from which a fluid, i.e., air, is sucked, is formed at a center of the first part 2*a* of the case 2. An outlet 2*d* is formed on an outer circumferential face of the case 2 and extended in a tangential direction thereof.

Figure 2:
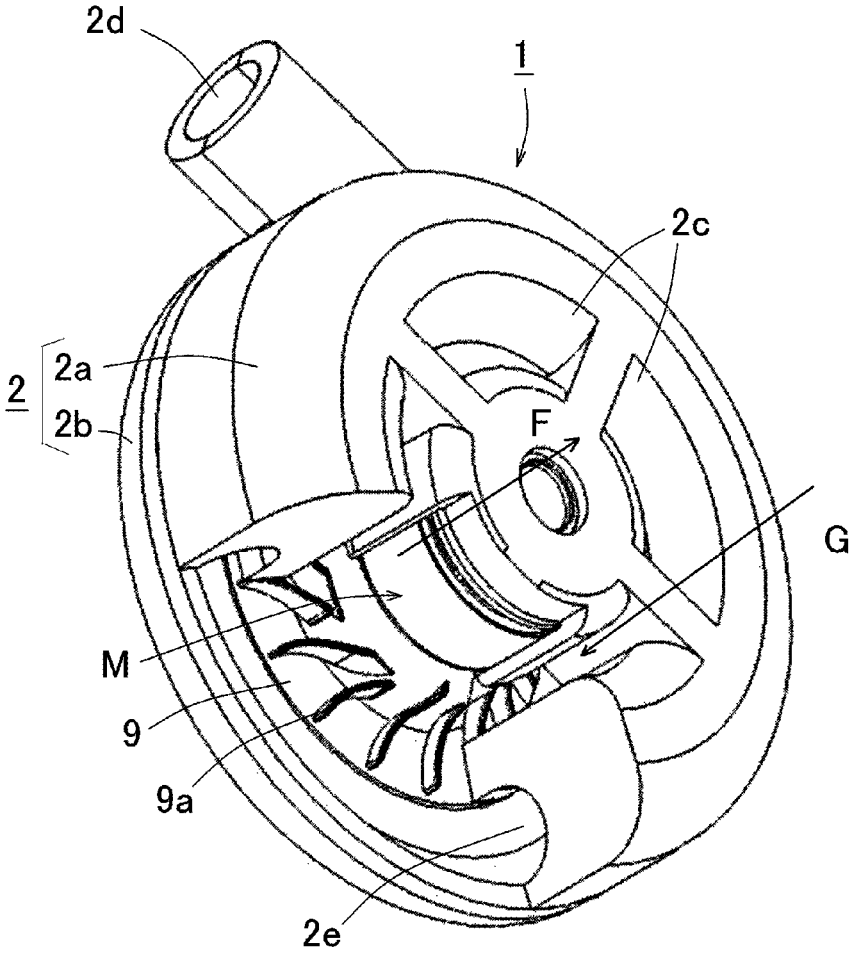
FIG. 2 is a partially cutaway perspective view of the blower of FIG. 1.

In FIG. 2, grooves are respectively formed in outer edge portions of the first part 2*a* and the second part 2*b*. The grooves are corresponded to each other, so that a compression chamber (flow path) 2*e* is formed.

Figure 3:
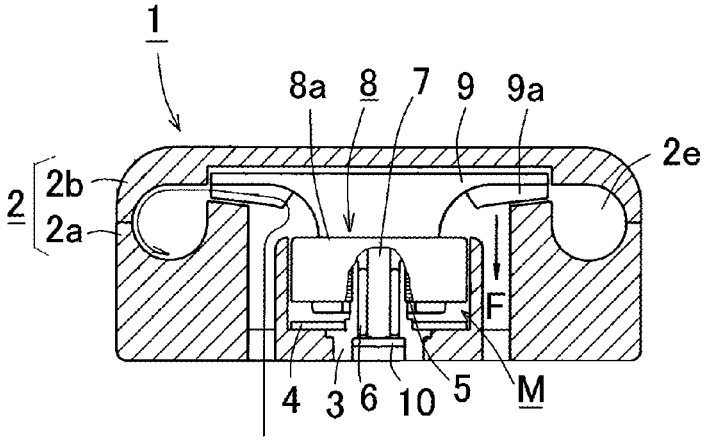
FIG. 3 is a vertical sectional view of the blower.
Figure 4:
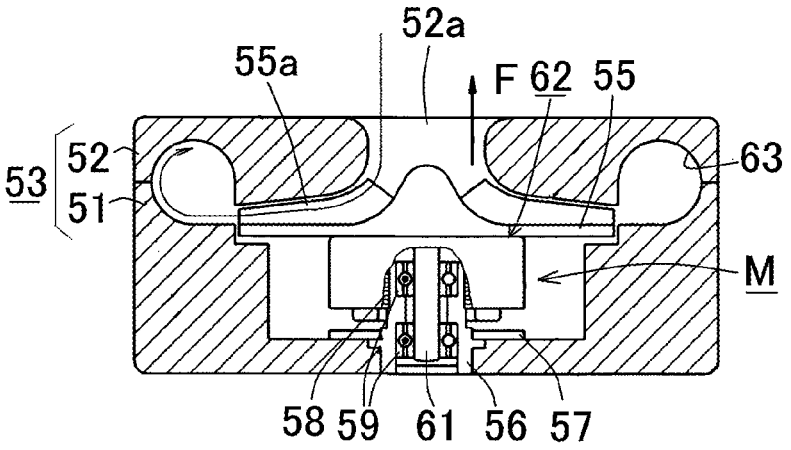
FIG.4 PRIOR ART
FIG. 4 is a vertical sectional view of the conventional blower.
Figure 5:
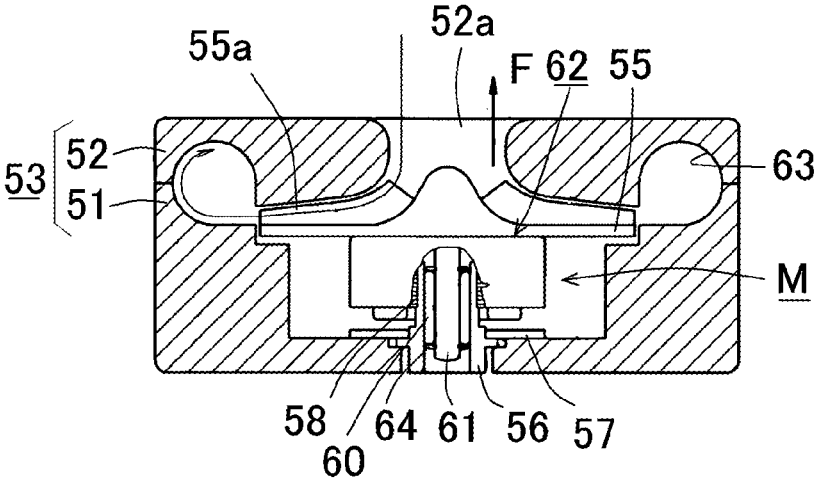
FIG.5 PRIOR ART
FIG. 5 is a vertical sectional view of another conventional blower.

In FIG. 3, a motor M and an impeller 9 are provided in the case 2. A bearing housing 3, which is formed into a cylindrical shape, is attached to the first part 2*a*. A motor circuit board 4 and a stator 5 are attached to the bearing housing 3. A slide bearing 6, e.g., oil retaining bearing, fluid dynamic bearing, is provided in the bearing housing 3. A rotor shaft 7 is supported by the slide bearing 6. A rotor 8 and the impeller 9 are integrally attached to one end side of the rotor shaft 7. The impeller 9 is fixed to the one end side of the rotor shaft 7 by, for example, molding, adhesive bonding or press fitting. In the rotor 8, a ring-shaped magnet (not shown) is provided on an inner circumferential wall of a cup-shaped rotor yoke 8*a*. The magnet faces pole teeth of the stator 5. Note that, the slide bearing 6 is capable of reducing noise, improving shock resistance, being used at high rotational speed and extending a span of life.

In the impeller 9, blades 9*a* are radially extended from a blade forming surface. The impeller 9 is attached to the rotor shaft 7 to make the blade forming surface face the rotor 8 in an axial direction (see FIG. 2). The other end of the rotor shaft 7, i.e., the opposite side to the impeller 9, is supported by a thrust receiving member 10, which is provided to the second part 2*b*. The shaft end, which is rounded, contacts the thrust receiving member 10 and can rotate thereon. The thrust receiving member 10 is made of a material having a superior sliding characteristic, e.g., polyether ether ketone.

By staring the motor M to rotate the impeller 9, a fluid, i.e., air, is sucked into the case 2, from the inlet 2*c*, in a direction of arrow G shown in FIG. 2. Further, the air is introduced into the compression chamber 2*e* along the blades 9*a*. The air is compressed, in the compression chamber 2*e*, by rotation of the impeller 9 and discharged from the outlet 2*d*.

By rotating the impeller 9, a lifting force F is axially applied to the impeller 9, and the impeller 9 is biased to lift toward the motor M (see FIG. 2). However, the shaft end of the rotor shaft 7 is supported by the thrust receiving member 10, so that an axial movement of the impeller 9 can be prohibited (see FIG. 3). Therefore, interference between the impeller 9 and the case 2 can be prevented, and reliability of the blower can be improved. Even in case that the air blower 1 is operated at a high rotational speed and the lifting force F is great, the shaft end of the rotor shaft 7, which is located on the motor M side and which contacts the thrust receiving member 10, has a rounded face, so that lifting the impeller 9 in the axial direction can be prevented and abrasion of the thrust receiving member 10 can be restrained.

Further, the bearing housing 3, the slide bearing 6, the motor M including the motor circuit board 4, the stator 5 and the rotor 8, and the impeller 9 are attached to the case 2 from one side, so the structure of the air blower 1 can be simplified and the air blower 1 can be assembled easily.

The fluid, i.e., air, is sucked into the case 2 from the motor M side and sent in the circumferential direction of the rotating impeller 9. With this structure, the fluid is sucked from the motor M side, where heat is generated, so that heat generation of the motor M can be restrained.

In the above described embodiment, the motor M is an outer rotor-type motor, but the motor M may be an inner rotor-type motor.

The slide bearing is used as an example of the radial bearing, but other bearings may be used as the radial bearing.

The air blower has been described as an example of the blower of the present invention, but the present invention may be applied to blowers for blowing other fluids, e.g., gas, steam.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present invention has been described in detail, it should be understood that the various changes, substitutions, and alternations could be made hereto without departing from the spirit and scope of the invention.

What is claimed is:

1. A blower, comprising:

a case;

a stator being provided in the case;

a radial bearing, which does not support a rotor shaft in a thrust direction, being provided in the case;

the rotor shaft being provided in the case and supported by the stator and the radial bearing;

a rotor being integrated with the rotor shaft; and an impeller being integrated with the rotor shaft, the rotating impeller sucking a fluid into the case from an axial direction and sending the same in the circumferential direction of the impeller, wherein the impeller is attached to the rotor shaft to make a blade forming surface of the impeller face the rotor in the axial direction, and a shaft end of the rotor shaft, which is located on the opposite side of the impeller, is formed into a rounded surface and supported by a thrust receiving member, the shaft end contacts the thrust receiving member and can rotate thereon.

2. The blower according to claim 1, wherein the fluid is sucked into the case from the motor side and sent in the circumferential direction of the rotating impeller.

3. The blower according to claim 1, wherein the radial bearing is a slide bearing.

* * * * *